US008898815B1

(12) United States Patent
Madigan

(10) Patent No.: US 8,898,815 B1
(45) Date of Patent: Dec. 2, 2014

(54) GLOVE SYSTEM WITH SCRUBBER

(71) Applicant: Evelyn F. Madigan, Prescott, AZ (US)

(72) Inventor: Evelyn F. Madigan, Prescott, AZ (US)

( * ) Notice: Subject to any disclaimer, the term of this patent is extended or adjusted under 35 U.S.C. 154(b) by 0 days.

(21) Appl. No.: 13/910,904

(22) Filed: Jun. 5, 2013

Related U.S. Application Data

(63) Continuation-in-part of application No. 13/198,424, filed on Aug. 4, 2011, now abandoned.

(51) Int. Cl.
*A41D 19/00* (2006.01)

(52) U.S. Cl.
CPC ..... *A41D 19/0024* (2013.01)
USPC ..... 2/161.8

(58) Field of Classification Search
CPC ..... A47L 13/18; A47L 13/19; A46B 5/04; A41D 19/0055; A41D 19/0089; A41D 19/01594; A41D 19/0044; A47K 7/02; B24D 15/045
USPC ..... 2/161.6, 160, 159, 167, 168; 15/227
See application file for complete search history.

(56) References Cited

U.S. PATENT DOCUMENTS

| | | | | | |
|---|---|---|---|---|---|
| 1,534,208 | A | * | 4/1925 | Gibson | 239/288 |
| 1,769,977 | A | * | 7/1930 | Watkins | 2/168 |
| 2,117,417 | A | | 5/1939 | Hall | |
| 2,227,707 | A | | 1/1941 | Cooper | |
| 2,821,718 | A | * | 2/1958 | Hall et al. | 2/162 |
| 3,151,333 | A | | 10/1964 | Paul | |
| 3,643,386 | A | * | 2/1972 | Grzyll | 451/523 |
| 4,038,787 | A | | 8/1977 | Bianchi | |
| 4,051,572 | A | | 10/1977 | Greenwood | |
| D268,968 | S | | 5/1983 | Sami | |
| 4,593,427 | A | * | 6/1986 | Ortolivo | 15/227 |
| 4,621,388 | A | * | 11/1986 | Ortolivo | 15/227 |
| 4,984,299 | A | | 1/1991 | Halldorsdottir | |
| 5,419,014 | A | | 5/1995 | Piantedosi | |
| 5,441,355 | A | | 8/1995 | Moore | |
| 5,953,756 | A | | 9/1999 | Vrissimdjis | |
| 5,956,770 | A | * | 9/1999 | Dennis | 2/160 |
| 6,016,571 | A | | 1/2000 | Guzman et al. | |
| 6,018,837 | A | | 2/2000 | Andreu | |
| 6,513,998 | B1 | | 2/2003 | Barry | |
| 7,210,171 | B2 | | 5/2007 | Jacobs et al. | |
| 7,269,859 | B2 | | 9/2007 | Wells | |
| D584,464 | S | | 1/2009 | Suran et al. | |
| 7,480,945 | B2 | | 1/2009 | Knuth | |
| 7,721,354 | B2 | | 5/2010 | Yu | |
| 7,823,245 | B2 | | 11/2010 | Firouzman | |
| 2002/0193060 | A1 | * | 12/2002 | Lowe et al. | 451/538 |
| 2005/0111897 | A1 | | 5/2005 | Presniakov | |
| 2008/0090506 | A1 | * | 4/2008 | Palushaj | 451/538 |
| 2011/0068028 | A1 | * | 3/2011 | Harriman et al. | 206/278 |

* cited by examiner

*Primary Examiner* — Khoa Huynh
*Assistant Examiner* — Anna Kinsaul

(57) ABSTRACT

A glove system that prohibits an aqueous solution used with a glove from running down an elevated arm onto a body of a user features a tubular glove hand component that is flexible. The system features a scrubber component located on a hand component palmar surface with a plurality of linear scrubber component reliefs located at each movable joint area of the hand component palmar surface. The system features a tubular glove arm component designed to cover a wrist and a forearm of the user. The system features a rigid glove cuff having a cylindrical cuff wall and an outer cuff wall. An intersection of a cylindrical cuff wall second end and an outer cuff wall second end features a direction reversing transition designed to offset an outer cuff wall inside surface from a cylindrical cuff wall outside surface an offset distance.

14 Claims, 4 Drawing Sheets

GLOVE SYSTEM WITH SCRUBBER

CROSS REFERENCE

This application claims priority to U.S. patent application Ser. No. 13/198,424 filed Aug. 4, 2011, the specification of which is incorporated herein in its entirety by reference.

FIELD OF THE INVENTION

The present invention relates to a glove, or more specifically, a glove used for scrubbing.

BACKGROUND OF THE INVENTION

Some cleaning chores require scrubbing with a brush or sponge using harsh chemicals or cleaners. Typically, protective gloves are used in this service to cover a hand of a user. Sometimes, when scrubbing overhead, these chemicals and cleaners can drip down an arm of the user onto their skin or clothes. The present invention features a glove system that prohibits an aqueous solution used with a glove from running down an elevated arm onto a body of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a glove system that prohibits an aqueous solution used with a glove from running down an elevated arm onto a body of a user. In some embodiments, the system comprises a tubular glove hand component. In some embodiments, the hand component is flexible.

In some embodiments, the system comprises a scrubber component located on hand component palmar surface. In some embodiments, the system comprises a plurality of linear scrubber component reliefs located on the hand component palmar surface. In some embodiments, the plurality of scrubber component reliefs are located at each movable joint area of the hand component palmar surface.

In some embodiments, the system comprises a tubular glove arm component. In some embodiments, the glove arm component is designed to cover a wrist and a forearm of a user. In some embodiments, the arm component is flexible.

In some embodiments, the system comprises a rigid glove cuff having a cylindrical cuff wall and an outer cuff wall. In some embodiments, an intersection of a cylindrical cuff wall second end and an outer cuff wall second end comprises a direction reversing transition designed to offset an outer cuff wall inside surface from a cylindrical cuff wall outside surface an offset distance. In some embodiments, "rigid" means that the material has the ability to hold shape. For example, the rigid cuff would not drip and collapse due to gravity. The flexible hand and arm components are flexible in that they can easily bend and collapse onto themselves due to gravity. In some embodiments, the rigid and flexible regions of the glove attach to each other at the arm component, at the transition region or point, as shown in FIG. 6. In some embodiments, the scrubber component is a single continuous piece stretching the entire palm, with grooves located at the appropriate positions for the fingers to bend.

DESCRIPTION OF PREFERRED EMBODIMENTS

Figure 1:
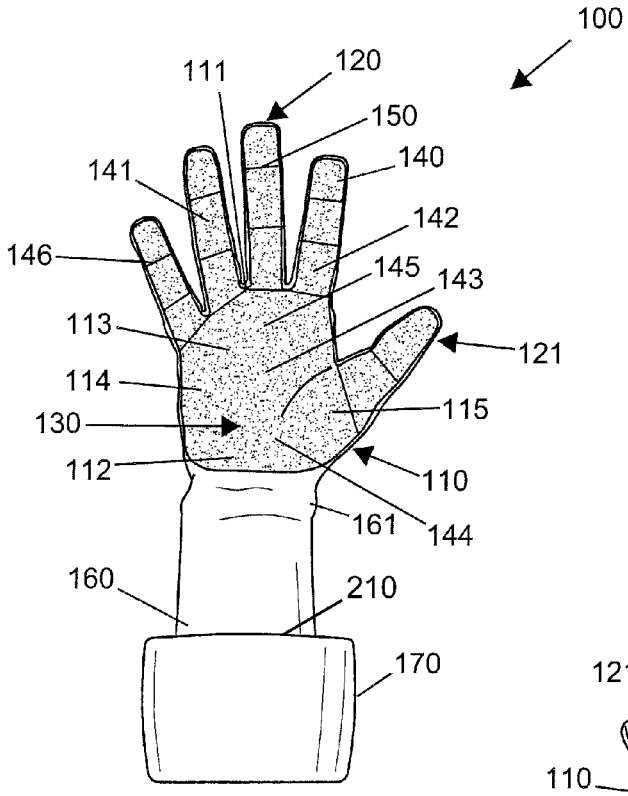
FIG. 1 shows a front view of the present invention.
Figure 2:
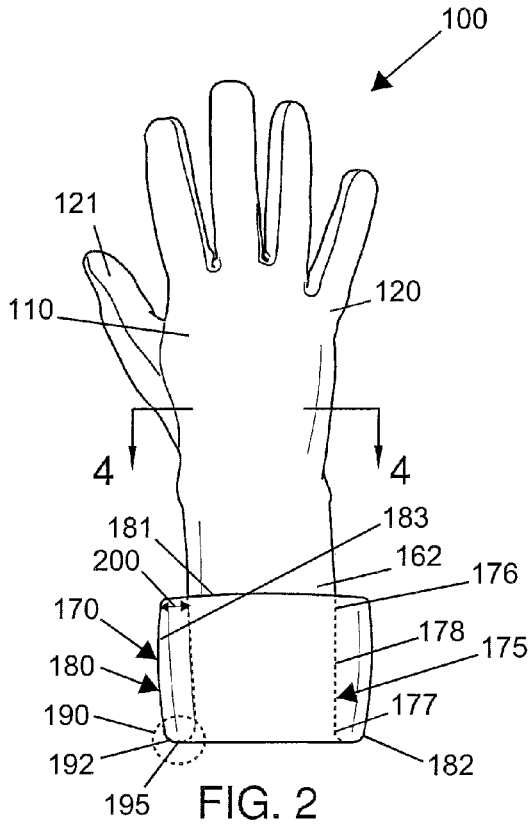
FIG. 2 shows a back view of the present invention.
Figure 3:
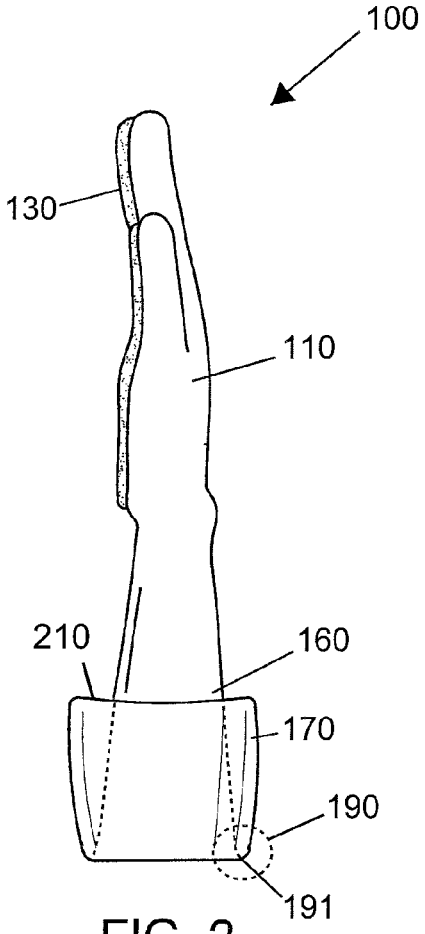
FIG. 3 shows a side view of the present invention.
Figure 4:
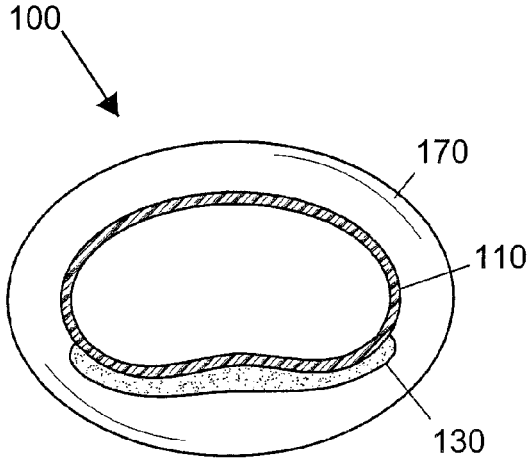
FIG. 4 shows a cross-sectional view of the present invention.
Figure 5:
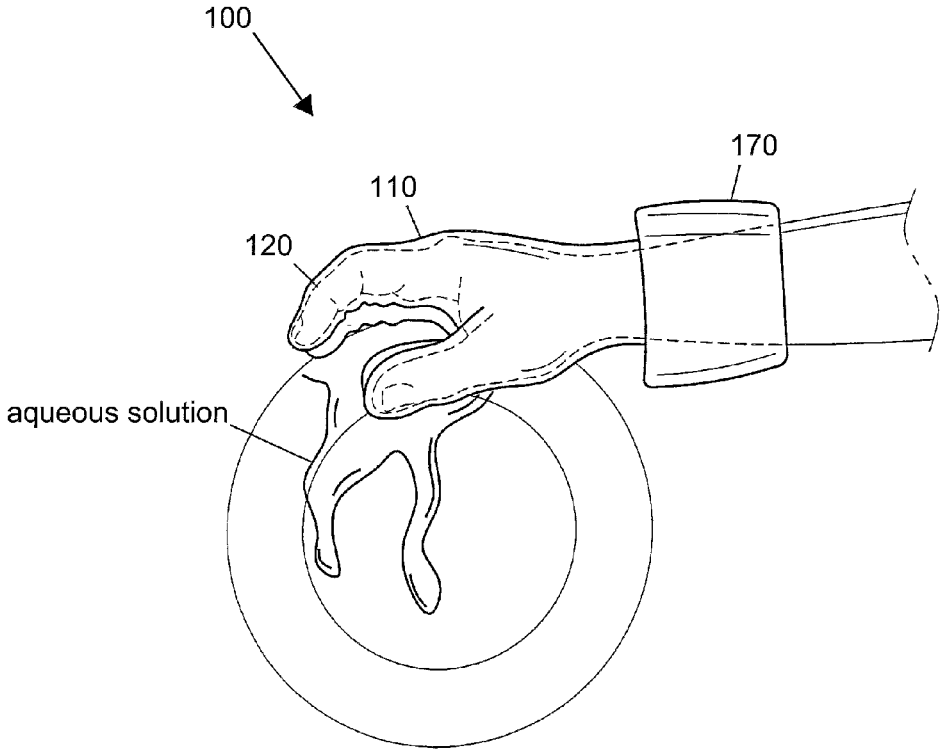
FIG. 5 shows a side view of the present invention.

Following is a list of elements corresponding to a particular element referred to herein:

100 Glove system
110 Glove hand component
111 Hand component anterior end
112 Hand component posterior end
113 Hand component palmar surface
114 Hand component first side
115 Hand component second side
120 Finger sheath
121 Thumb sheath
130 Scrubber component
140 Palmer distal phalange area
141 Palmer intermediate phalange area
142 Palmer proximal phalange area
143 Palmer palm area
144 Palmer heel area
145 Palmer metacarpal area
146 Palmer movable joint area
150 Scrubber component relief
160 Glove arm component
161 Arm component first end
170 Glove cuff
175 Cylindrical cuff wall
176 Cylindrical cuff first end
177 Cylindrical cuff second end
178 Cylindrical cuff wall outside surface
180 Outer cuff wall
181 Outer cuff first end
182 Outer cuff second end
183 Outer cuff wall inside surface
190 Direction reversing transition
191 Cuff angle
192 Arcuate transition zone
195 Trough
200 Offset distance; 210 Lip Referring now to FIG. 1-6, the present invention features a glove system (100) that prohibits an aqueous solution used with a glove from running down an elevated arm onto a body of a user. In some embodiments, the aqueous solution is a cleaning fluid. In some embodiments, the aqueous solution is soapy water.

In some embodiments, the system (100) comprises a tubular glove hand component (110) having a hand component anterior end (111), an open hand component posterior end (112), and a hand component palmar surface (113). In some embodiments, four finger sheaths (120) extend out and away from the hand component anterior end (111). In some embodiments, a thumb sheath (121) extends out and away from a hand component first side (114) or a hand component second side (115). In some embodiments the glove hand component (110) is flexible. In some embodiments, the glove hand component (110) is stretchable.

In some embodiments, the system (100) comprises a scrubber component (130) disposed on hand component palmar surface (113). In some embodiments, the hand component palmar surface (113) comprises a plurality of palmar distal phalange areas (140), a plurality of palmar intermediate phalange areas (141), and a plurality of palmar proximal phalange areas (142) of the four finger sheaths (120) and the thumb sheath (121) in addition to the palmer palm area (143) and the palmer heel area (144) of the glove hand component (110). In some embodiments, the thumb sheath (121) does not comprise a palmar intermediate phalange area (141). In some embodiments, the scrubber component (130) is disposed over the entire hand component palmar surface (113).

In some embodiments, the system (100) comprises a plurality of linear scrubber component reliefs (150) disposed on the hand component palmar surface (113) between each palmer distal phalange area (140) and its adjacent palmer intermediate phalange area (141), each palmer intermediate phalange area (141) and its adjacent palmer proximal phalange area (142), and each palmer proximal phalange area and its adjacent palmer metacarpal area (145). In some embodiments, the plurality of scrubber component reliefs (150) is disposed at each palmer movable joint area (146) area of the hand component palmar surface (113). In some embodiments, the linear scrubber component reliefs (150) allow additional flexibility for bending a finger of a user. In some embodiments, additional linear scrubber component reliefs (150) may be located on the hand component palmar surface (113). In some embodiments, a linear scrubber component relief (150) is a linear area that is not covered by the scrubber component (130) like a groove or a channel. In some embodiments, the scrubber component relief (150) is 1/16". In some embodiments, the scrubber component relief (150) is 1/8". In some embodiments, the scrubber component relief (150) is 3/16". In some embodiments, the scrubber component relief (150) is 1/4".

In some embodiments, the system (100) comprises a tubular glove arm component (160) having an arm component first end (161) disposed on the hand component posterior end (112). In some embodiments, the glove arm component (160) is designed to cover a wrist and a forearm of the user. In some embodiments, the glove arm component (160) is flexible.

In some embodiments, the system (100) comprises a rigid glove cuff (170) having a cylindrical cuff wall (175) disposed inside an outer cuff wall (180). In some embodiments, the cylindrical cuff wall (175) is of the same height as that of the outer cuff wall (180). In some embodiments, the cylindrical cuff wall (175) has a height that is same height as that of the outer cuff wall (180). In some embodiments, the cylindrical cuff wall (175) has a height that is longer than that of the outer cuff wall (180). In some embodiments, the cylindrical cuff wall (175) comprises a cylindrical cuff first end (176) disposed on an arm component second end (162) and a cylindrical cuff second end (177) disposed on an outer cuff second end (182). In some embodiments, the outer cuff first end (181) comprises a terminating edge having a lip that faces a same direction as the hand component anterior end (111). In some embodiments, an intersection of the cylindrical cuff second end (177) and the outer cuff second end (182) comprises a direction reversing transition (190) acting as a U-turn component. In some embodiments, the direction reversing transition (190) is designed to offset the outer cuff wall inside surface (183) from the cylindrical cuff wall outside surface (178) an offset distance (200). In some embodiments, the direction reversing transition (190) is designed to offset the outer cuff first end (181) from the cylindrical cuff first end (176) an offset distance (200). In some embodiments, a cross-section of the glove cuff (170) resembles a "J", see for example FIG. 6. In some embodiments, a cross-section of the glove cuff (170) resembles a "U". In some embodiments, a cross-section of the glove cuff (170) resembles a "V". The "J", "U" or "V" structure is rigid, and the remainder of the glove is made up of flexible material.

In some embodiments, the outer cuff wall (180) is conical from the outer cuff first end (176) to the outer cuff second end (177). In some embodiments, the outer cuff wall (180) is barrel shaped from the outer cuff first end (176) to the outer cuff second end (177).

Figure 6:
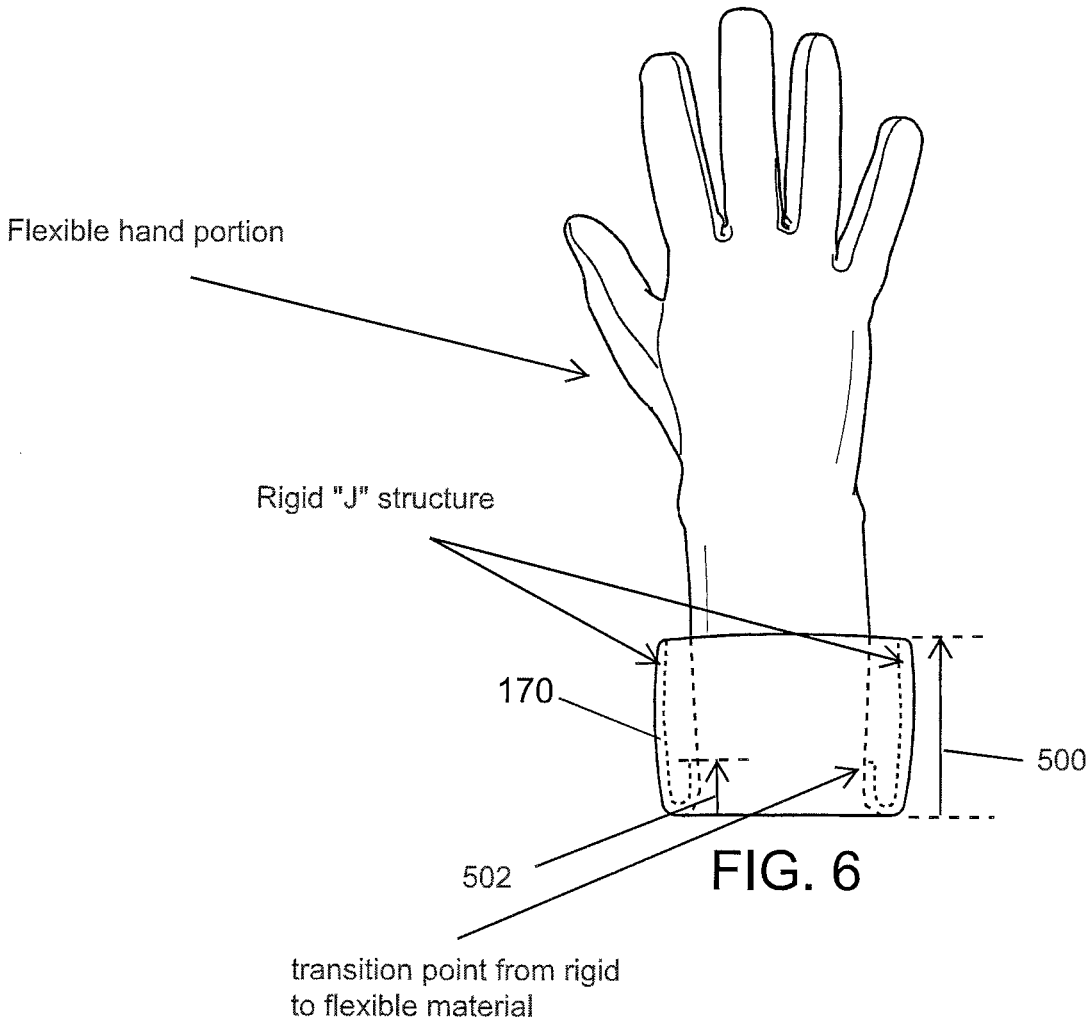
FIG. 6 shows a cross section of the cuff having a rigid "J" structure.

In some embodiments a cylindrical cuff wall height (502) is the same as or shorter than an outer wall cuff wall height (500), shown in FIG. 6.

In some embodiments, the glove hand component (110) and the glove arm component (160) are constructed from a flexible rubber or latex rubber.

In some embodiments, the transition comprises a cuff angle (191). In some embodiments, the cuff angle (191) is 10 degrees or less. In some embodiments, the cuff angle (191) is 20 degrees. In some embodiments, the cuff angle (191) is 30 degrees or more.

In some embodiments, the scrubber component (130) is constructed from spun propylene fiber. In some embodiments, the scrubber component (130) is ScotchBrite™.

In some embodiments, the transition comprises an arcuate transition zone (192) having a trough (195). In some embodiments, an arc comprises 180 degrees or more. In some embodiments, an arc comprises 170 degrees. In some embodiments, an arc comprises 160 degrees or less.

In some embodiments, the offset distance (200) is 1/4" or less. In some embodiments, the offset distance (200) is 1/2". In some embodiments, the offset distance (200) is 3/4" or more.

As used herein, the term "about" refers to plus or minus 10% of the referenced number.

The disclosures of the following U.S. Patents are incorporated in their entirety by reference herein: U.S. Pat. No. 2,227,707; U.S. Pat. No. 3,643,386; U.S. Pat. No. 5,441,355; U.S. Pat. No. 6,016,571; U.S. Pat. No. 6,018,837; U.S. Pat. No. 6,513,998; U.S. Pat. No. 7,210,171; U.S. Pat. No. 7,721,354; U.S. Pat. No. 7,823,245; U.S. Pat. No. D 268,968; and U.S. Pat. No. D 584,464.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A glove system (100) that prohibits an aqueous solution used with a glove from running down an elevated arm onto a body of a user, wherein the system (100) comprises:

(a) a tubular glove hand component (110) having a hand component anterior end (111), an open hand component posterior end (112), and a hand component palmar surface (113), wherein four finger sheaths (120) extend out and away from the hand component anterior end (111), wherein a thumb sheath (121) extends out and away from a hand component first side (114) or a hand component second side (115), wherein the glove hand component (110) is flexible;

(b) a scrubber component (130) disposed on the entire hand component palmar surface (113), wherein the hand component palmar surface (113) comprises a plurality of palmar distal phalange areas (140), a plurality of palmar intermediate phalange areas (141), and a plurality of palmar proximal phalange areas (142) of the four finger sheaths (120) and the thumb sheath (121) in addition to a palmer palm area (143) and a palmer heel area (144) of the glove hand component (110);

(c) a plurality of linear scrubber component reliefs (150) disposed on the hand component palmar surface (113) between each palmer distal phalange area (140) and its adjacent palmer intermediate phalange area (141), each palmer intermediate phalange area (141) and its adjacent palmer proximal phalange area (142), and each palmer proximal phalange area and its adjacent palmer metacarpal area (145), wherein the plurality of scrubber component reliefs (150) is disposed at each palmer movable joint area (146) of the hand component palmar surface (113);

(d) a tubular glove arm component (160) having an arm component first end (161) disposed on the hand component posterior end (112), wherein the glove arm component (160) is designed to cover a wrist and a forearm of the user, wherein the glove arm component (160) is flexible; and (e) a glove cuff (170) having a cylindrical cuff wall (175) disposed inside an outer cuff wall (180), wherein the cylindrical cuff wall (175) comprises a cylindrical cuff first end (176) adjacent to an arm component second end (162) and connected to a cylindrical cuff second end (177) adjacent to and contiguous with an outer cuff second end (182), wherein a trough (195) is formed between the cylindrical cuff second end (177) and the outer cuff second end (182); wherein an outer cuff first end (181) comprises a terminating edge having a lip that faces a same direction as the hand component anterior end (111), wherein an intersection of the cylindrical cuff second end (177) and the outer cuff second end (182) comprises a direction reversing transition (190) acting as a U-turn component, wherein the direction reversing transition (190) is designed to offset an outer cuff wall inside surface (183) from a cylindrical cuff wall outside surface (178) an offset distance (200), wherein a cylindrical cuff wall height (502) is the same as or shorter than an outer wall cuff wall height (500); and wherein the outer cuff wall (180), the trough (195), and a first portion of the cylindrical cuff wall (175) between the cylindrical cuff first end (176) and the cylindrical cuff second end (177) is rigid and a second portion of the cylindrical cuff wall (175) between the cylindrical cuff first end (176) and the cylindrical cuff second end (177) is flexible and wherein the rigid first portion between the cylindrical cuff first end (176) and the cylindrical cuff second end (177) is adjacent and contiguous with the trough (195) and the outer cuff wall (180).

2. The system of claim 1, wherein the glove hand component (110) and the glove arm component (160) are constructed from a flexible rubber or latex rubber.

3. The system of claim 1, wherein the transition comprises a cuff angle (191).

4. The system of claim 3, wherein the cuff angle (191) is 20 degrees.

5. The system of claim 1, wherein the scrubber component (130) is constructed from spun propylene fiber.

6. The system of claim 1, wherein the transition comprises an arcuate transition zone (192) having a trough (195), wherein an arc comprises 170 degrees.

7. The system of claim 1, wherein the offset distance (200) is ¾ inch or more.

8. A glove system (100) that prohibits an aqueous solution used with a glove from running down an elevated arm onto a body of a user, wherein the system (100) consists of:

(a) a tubular glove hand component (110) having a hand component anterior end (111), an open hand component posterior end (112), and a hand component palmar surface (113), wherein four finger sheaths (120) extend out and away from the hand component anterior end (111), wherein a thumb sheath (121) extends out and away from a hand component first side (114) or a hand component second side (115), wherein the glove hand component (110) is flexible;

(b) a scrubber component (130) disposed on the entire hand component palmar surface (113), wherein the hand component palmar surface (113) comprises a plurality of palmar distal phalange areas (140), a plurality of palmar intermediate phalange areas (141), and a plurality of palmar proximal phalange areas (142) of the four finger sheaths (120) and the thumb sheath (121) in addition to a palmer palm area (143) and a palmer heel area (144) of the glove hand component (110);

(c) a plurality of linear scrubber component reliefs (150) disposed on the hand component palmar surface (113) between each palmer distal phalange area (140) and its adjacent palmer intermediate phalange area (141), each palmer intermediate phalange area (141) and its adjacent palmer proximal phalange area (142), and each palmer proximal phalange area and its adjacent palmer metacarpal area (145), wherein the plurality of scrubber component reliefs (150) is disposed at each palmer movable joint area (146) of the hand component palmar surface (113);

(d) a tubular glove arm component (160) having an arm component first end (161) disposed on the hand component posterior end (112), wherein the glove arm component (160) is designed to cover a wrist and a forearm of the user, wherein the glove arm component (160) is flexible; and (e) a glove cuff (170) having a cylindrical cuff wall (175) disposed inside an outer cuff wall (180), wherein the cylindrical cuff wall (175) comprises a cylindrical cuff first end (176) adjacent to an arm component second end (162) and connected to a cylindrical cuff second end (177) adjacent to and contiguous with an outer cuff second end (182), wherein a trough (195) is formed between the cylindrical cuff second end (177) and the outer cuff second end (182); wherein an outer cuff first end (181) comprises a terminating edge having a lip that faces a same direction as the hand component anterior end (111), wherein an intersection of the cylindrical cuff second end (177) and the outer cuff second end (182) comprises a direction reversing transition (190) acting as a U-turn component, wherein the direction reversing transition (190) is designed to offset an outer cuff wall inside surface (183) from a cylindrical cuff wall outside surface (178) an offset distance (200), wherein a cylindrical cuff wall height (502) is the same as or shorter than an outer wall cuff wall height (500); and wherein the outer cuff wall (180), the trough (195), and a first portion of the cylindrical cuff wall (175) between the cylindrical cuff first end (176) and the cylindrical cuff second end (177) is rigid and a second portion of the cylindrical cuff wall (175) between the cylindrical cuff first end (176) and the cylindrical cuff second end (177) is flexible and wherein the rigid first portion between the cylindrical cuff first end (176) and the cylindrical cuff second end (177) is adjacent and contiguous with the trough (195) and the outer cuff wall (180).

9. The system of claim 1, wherein the cuff angle (191) is 10 degrees or less.

10. The system of claim 1, wherein the cuff angle (191) is 30 degrees or more.

11. The system of claim 1, wherein the transition comprises an arcuate transition zone (192) having a trough (195), wherein an arc comprises 180 degrees or more.

12. The system of claim 1, wherein the transition comprises an arcuate transition zone (192) having a trough (195), wherein an arc comprises 160 degrees or less.

13. The system of claim 1, wherein the offset distance (200) is ¼" or less.

14. The system of claim 1, wherein the offset distance (200) is ½".

* * * * *